US008381620B1

(12) United States Patent
Cheng

(10) Patent No.: US 8,381,620 B1
(45) Date of Patent: Feb. 26, 2013

(54) OPEN WRENCH

(76) Inventor: Chin-Shun Cheng, Taichung (TW)

( * ) Notice: Subject to any disclaimer, the term of this patent is extended or adjusted under 35 U.S.C. 154(b) by 0 days.

(21) Appl. No.: 13/267,911

(22) Filed: Oct. 7, 2011

(51) Int. Cl.
*B25B 13/12* (2006.01)
*B25B 13/00* (2006.01)

(52) U.S. Cl. ..... 81/179; 81/186; 81/185.2

(58) Field of Classification Search ..... 81/179, 81/186, 126, 185.1, 185.2
See application file for complete search history.

(56) References Cited

U.S. PATENT DOCUMENTS

| | | | | | |
|---|---|---|---|---|---|
| 879,155 | A | * | 2/1908 | Ellis | 81/179 |
| 1,473,123 | A | * | 11/1923 | Pearce et al. | 81/179 |
| 1,898,388 | A | * | 2/1933 | Parker | 81/179 |
| 2,646,711 | A | * | 7/1953 | Yavner | 81/179 |
| 2,730,000 | A | * | 1/1956 | Crittenden, Jr. | 81/179 |
| 2,879,681 | A | * | 3/1959 | Blasdell | 81/179 |
| 2,910,902 | A | * | 11/1959 | Akers | 81/179 |
| 2,983,173 | A | * | 5/1961 | Buxton, Jr. | 81/179 |
| 3,023,654 | A | * | 3/1962 | Stambaugh et al. | 81/179 |
| 5,533,428 | A | * | 7/1996 | Pradelski | 81/179 |
| 5,582,083 | A | * | 12/1996 | Baker | 81/119 |
| 6,131,493 | A | * | 10/2000 | Yamamoto et al. | 81/124.7 |
| 6,289,772 | B1 | * | 9/2001 | Ying-Wen | 81/119 |
| 6,354,175 | B1 | * | 3/2002 | Dobson et al. | 81/119 |
| 7,255,026 | B1 | * | 8/2007 | Lee | 81/179 |
| 7,261,020 | B2 | * | 8/2007 | Hsieh | 81/121.1 |

* cited by examiner

*Primary Examiner* — Bryan R Muller

(57) ABSTRACT

An open wrench includes a recess defined by two clamp surfaces and two engaging surfaces to mount to a bolt head. One of the clamp surfaces has a passage and the movable member is located in the passage. The movable member has a spherical distal end and protrudes from the clamp surface. Each of the clamp surfaces has a tangential surface and a distance between the two tangential surfaces is longer than the maximum distance between two corners of the bolt head. An angle is defined between the axis of the passage and the tangential surface of the clamp surface. The clip is engaged within the passage and the outer periphery of the clip is engaged with the annular groove and the inner periphery of the clip protrudes from the extension so as to contact the second shoulder to prevent the movable member from dropping from the passage.

6 Claims, 12 Drawing Sheets

OPEN WRENCH

FIELD OF THE INVENTION

The present invention relates to a wrench, and more particularly, to an open wrench that is operated as a ratchet wrench.

BACKGROUND OF THE INVENTION

A conventional open wrench is disclosed in U.S. Pat. No. 3,023,654 and Taiwan Patent Application No. 094220070, and generally includes an open wrench head having a recess and a hole is defined in the inside of the recess. The recess accommodates the bolt head which is rotated when the wrench is rotated. The hole is sealed by an end piece and a block and a spring are received in the hole. The two ends of the spring respectively bias the block and the end piece so as to provide a force to push the block toward the recess. A protrusion or a bent portion is defined in the recess and located close to the opening so as to prevent the block from dropping from the hole. The drawbacks are that the flange or bent portion has to be made and which has to be precisely located otherwise the movement of the block cannot be in contact with the head of the bolt, this could lead failure of the ratchet function of the wrench. The other drawback is that the flange decides the movement of the block and if the position of the flange is not correctly set, the driving head has to be cut to be thinner by precise cutting which generally is 0.5 mm cutting, and this may damage the driving head and increase the manufacturing cost.

The present invention intends to provide an open wrench which has simplified structure and reduces the manufacturing cost.

SUMMARY OF THE INVENTION

The present invention relates to an open wrench and includes a body, a movable member, a spring and a clip. The recess is defined by two clamp surfaces and two engaging surfaces to mount to a bolt head. One of the clamp surfaces has a passage and the movable member is located in the passage. The movable member has a spherical distal end and protrudes from the clamp surface. Each of the clamp surfaces has a tangential surface and a distance between the two tangential surfaces is longer than the maximum distance between two corners of the bolt head. An angle is defined between the axis of the passage and the tangential surface of the clamp surface. The clip is engaged within the passage and the outer periphery of the clip is engaged with the annular groove and the inner periphery of the clip protrudes from the extension so as to contact the second shoulder to prevent the movable member from dropping from the passage.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
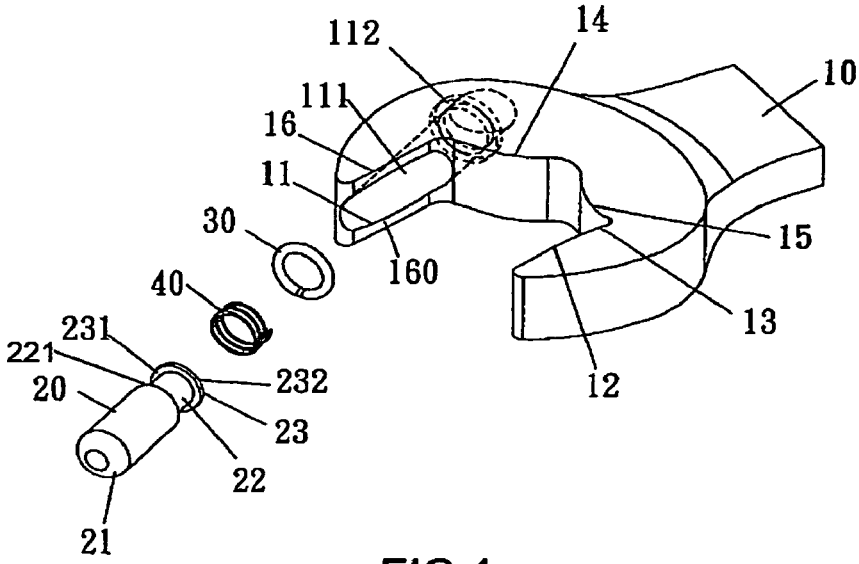
FIG. 1 is an exploded view to show the open wrench of the present invention.
Figure 2:
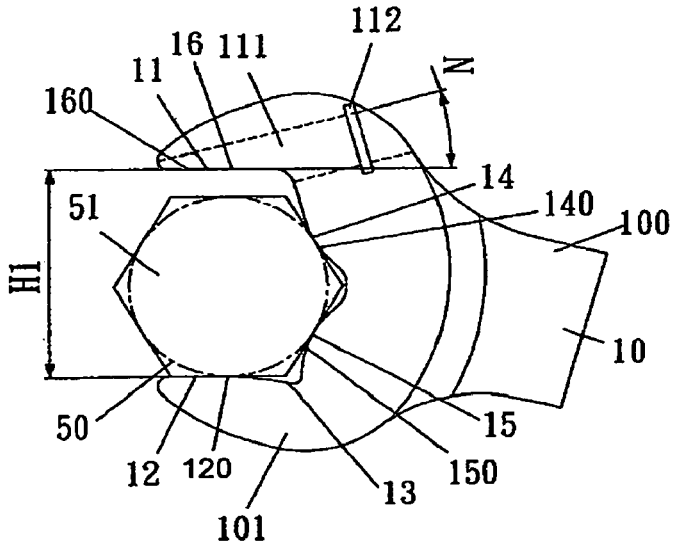
FIG. 2 is a top view of the open wrench of the present invention.

Referring to FIGS. 1 to 5, the open wrench of the present invention comprises a body 10, a movable member 20, a clip 30 and a spring 40.

The body 10 has a handle 100 and a driving head 101 is connected to an end of the handle 100. A recess 11 is defined through the driving head 101 so as to define a first clamp surface 12 and a second clamp surface 16 on two insides thereof. A first engaging surface 14 extends from the second clamp surface 16 and a second engaging surface 15 extends from the first clamp surface 12. An opening 110 is defined between the first and second clamp surfaces 12, 16 and communicates with the recess 11. The first clamp surface 12, the first engaging surface 14 and the second engaging surface 15 respectively have a first tangential surface 120, a second tangential surface 140 and a third tangential surface 150. The three respective tangential surfaces 120, 140, 150 are located on three consecutive sides of a hexagon. The three tangential surfaces 120, 140, 150 contact three consecutive sides of a hexagonal head 51 of the bolt 50. The second clamp surface 16 has a most protruding portion which has a fourth surface 160 which is parallel to the first tangential surface 120. The distance H1 between the first tangential surface 120 and the fourth surface 160 is longer than the maximum distance between two corners of the hexagonal head 51. The driving head 101 has a passage 111 defined therethrough. An angle N is defined between the axis of the passage 111 and the fourth surface 160. The range of the angle N is between 15 degrees to 25 degrees. An annular groove 112 is defined in the inner periphery of the passage 111. An inner periphery of the clip 30 protrudes into the passage 111 and is engaged with the second shoulder 231 to prevent the movable member 20 from dropping from the passage 111. The first clamp surface 12 is a curved and convex surface or a plane surface. A notch 13 is defined in the connection portion between the first clamp surface 12 and the first engaging surface 14, one of corners of the hexagonal head 51 is engaged with the notch 13. Each of the first engaging surface 14 and the second engaging surface 15 is a curved and convex surface or a plane surface. The first clamp surface 12, the first engaging surface 14 and the second engaging surface 15 contact the three sides of the hexagonal head 51.

The movable member 20 is a cylindrical member and movably received in the passage 111 and has an extension 22 extending from an end thereof. The diameter of the extension 22 is smaller than the diameter of the movable member 20 so as to define a first shoulder 221 at the conjunction portion between the movable member 20 and the extension 22. The extension 22 has an enlarged block 23 at a distal end thereof so as to define a second shoulder 231 at the conjunction portion between the block 23 and the movable member 20.

The clip 30 is a resilient ring and the outer periphery of the clip 30 is engaged with the annular groove 112 and the inner periphery of the clip 30 protrudes from the annular groove 112 and is located corresponding to the extension 22 so as to contact the second shoulder 231 to prevent the movable member 20 from dropping from the passage 111.

The spring 40 is mounted to the extension 22 of the movable member 20 and biased between the first shoulder 221 and the clip 30 so as to provide a force to push the movable member 20 toward the recess 11.

Figure 4:
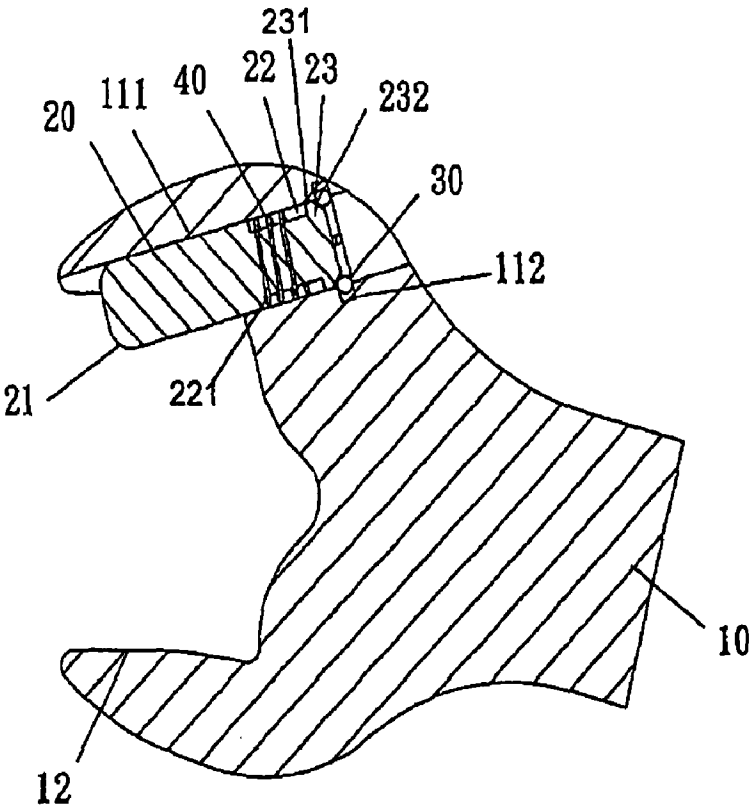
FIG. 4 is a cross sectional view taken along line A-A of FIG. 3.
Figure 3:
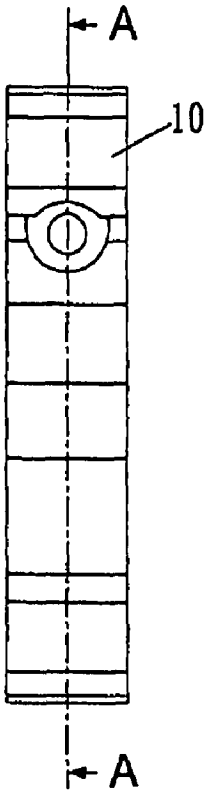
FIG. 3 is a side view of the open wrench of the present invention.
Figure 6:
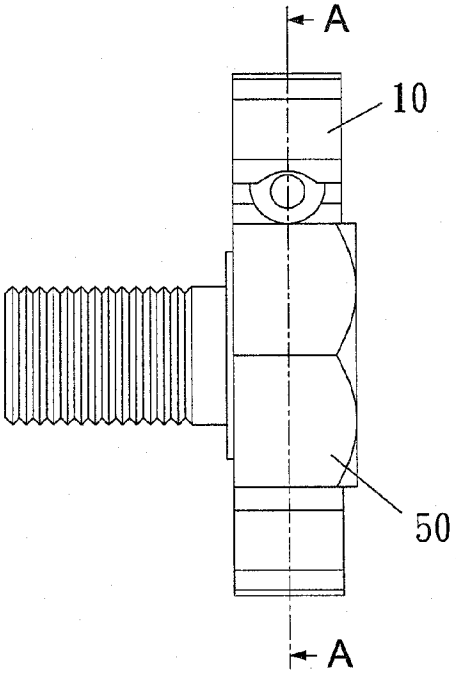
FIG. 6 is a side view to show that the open wrench is mounted to a bolt.
Figure 5:
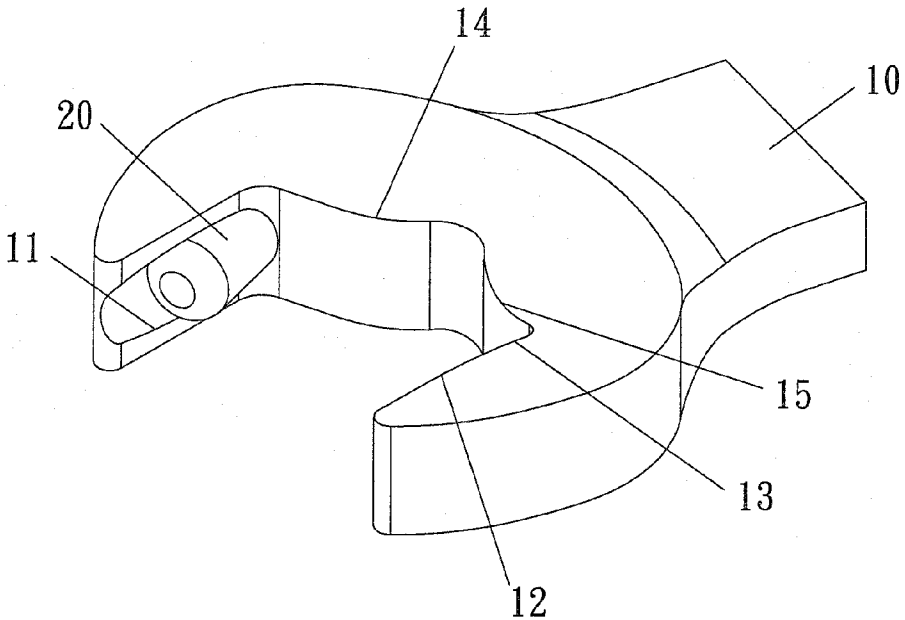
FIG. 5 is a perspective view of the open wrench of the present invention.
Figure 7:
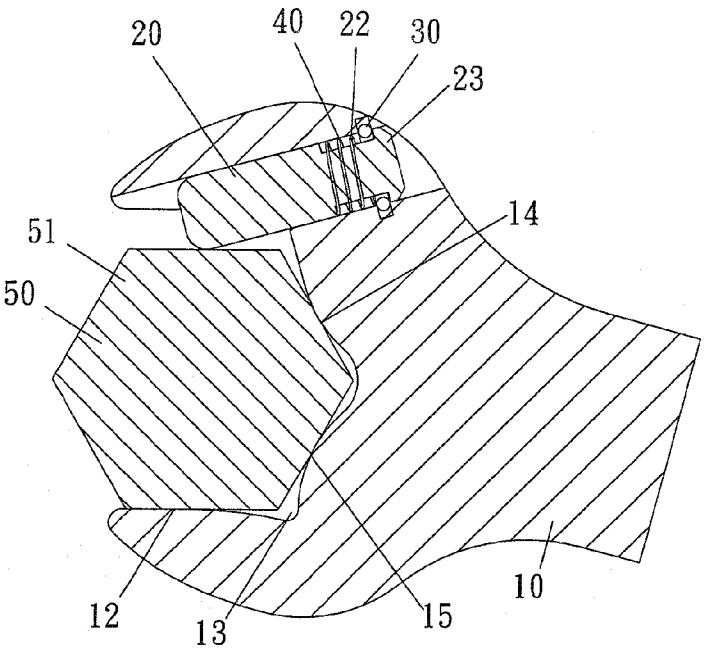
FIG. 7 is a cross sectional view taken along line A-A of FIG. 6.

As shown in FIGS. 3 to 7, when assembling, the clip 30 is first engaged with the annular groove 112 and the spring 40 is mounted to the extension 22 with one end of the spring 40 contacting the first shoulder 221. The movable member 20 is put in the passage 111 and the inclined surface 232 extends through the clip 30 (FIG. 4 shows that the inclined surface 232 does not extend through the clip 30 and FIG. 7 shows that the inclined surface 232 extends through the clip 30). When the clip 30 bounces back, it contacts the second shoulder 231. The spring 40 is biased between the first shoulder 221 and the clip 30 so as to position the movable member 20 in the passage 111. The distal end 21 protrudes from the second clamp surface 16 so as to contact one side of the hexagonal head 51. The first clamp surface 12, the first engaging surface 14 and the second engaging surface 15 contact the three sides of the hexagonal head 51. One corner of the hexagonal head 51 is engaged with the notch 13.

Figure 8:
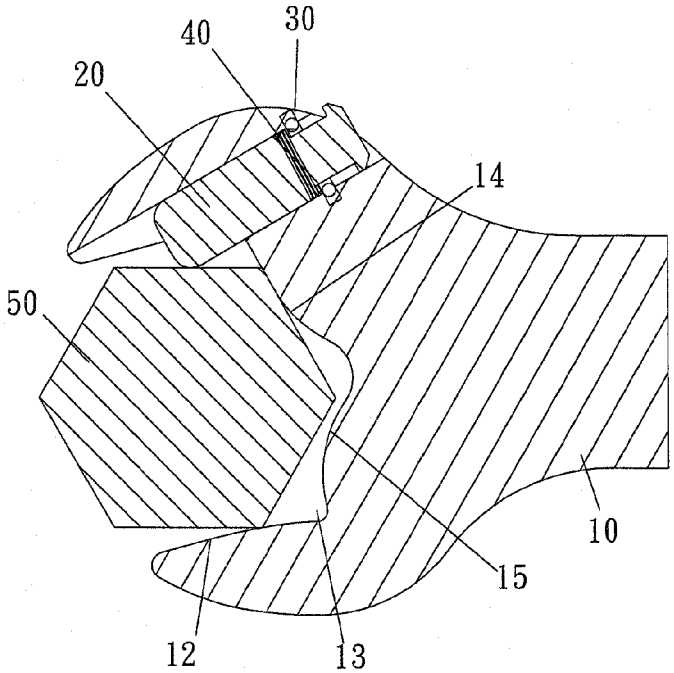
FIG. 8 shows that the driving head is located at the first return position.
Figure 10:
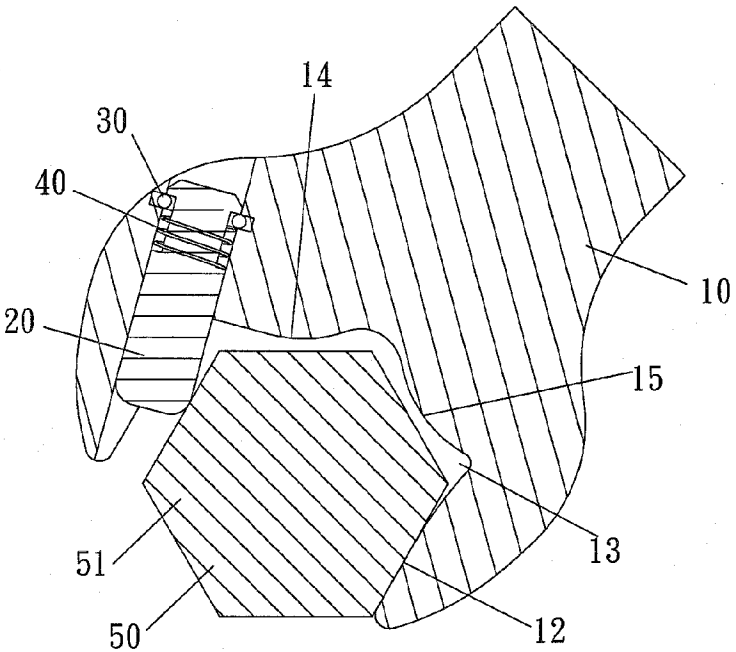
FIG. 10 shows that the driving head is located at the third return position.
Figure 9:
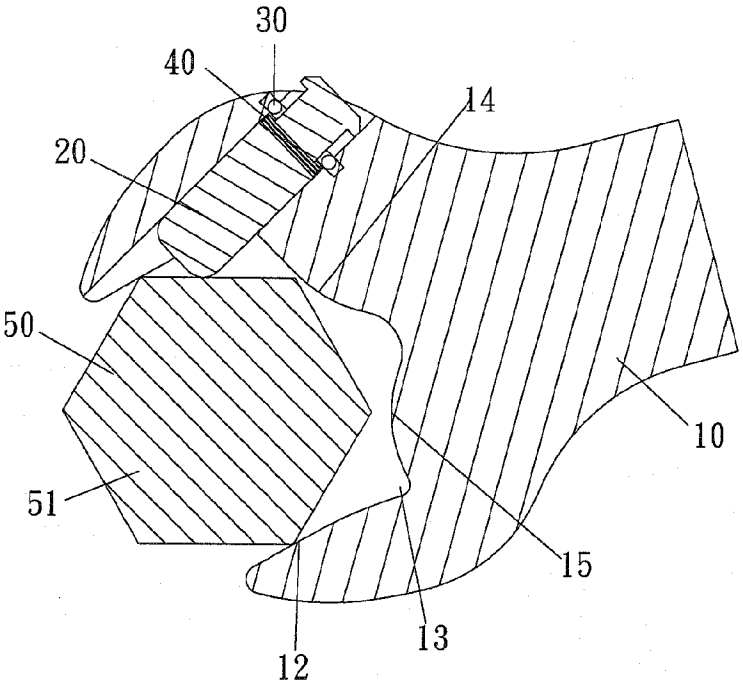
FIG. 9 shows that the driving head is located at the second return position.
Figure 12:
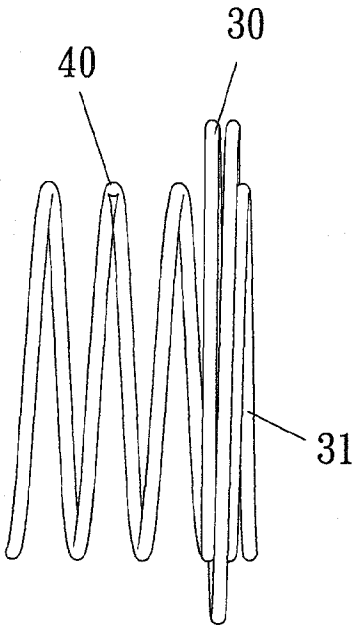
FIG. 12 is a side view of the second embodiment of the spring and the clip.
Figure 11:
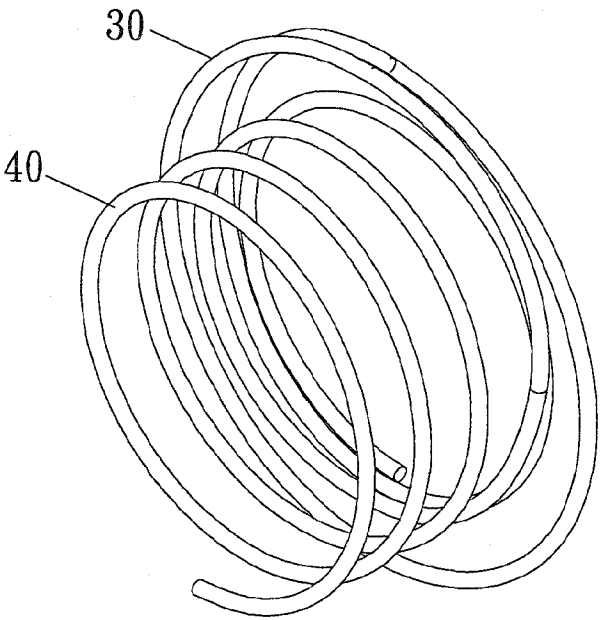
FIG. 11 shows the second embodiment of the spring and the clip.
Figure 14:
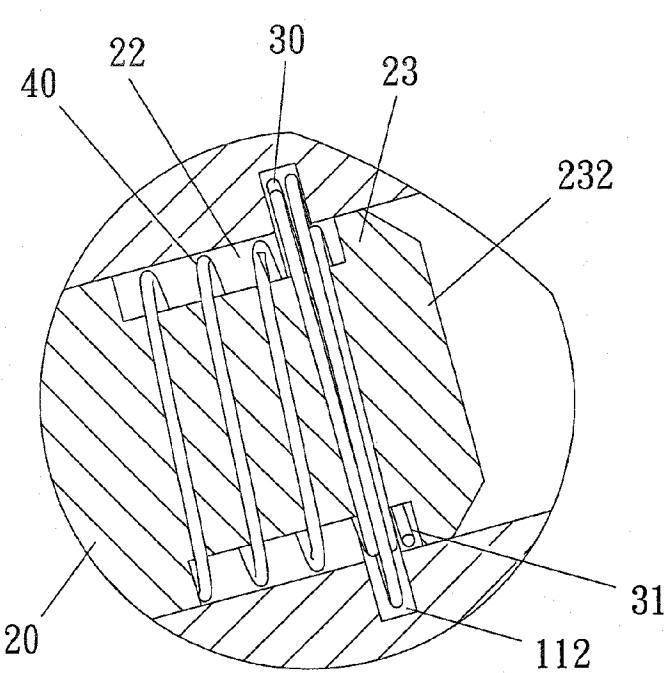
FIG. 14 is an enlarged view of the circle B in FIG. 13.
Figure 13:
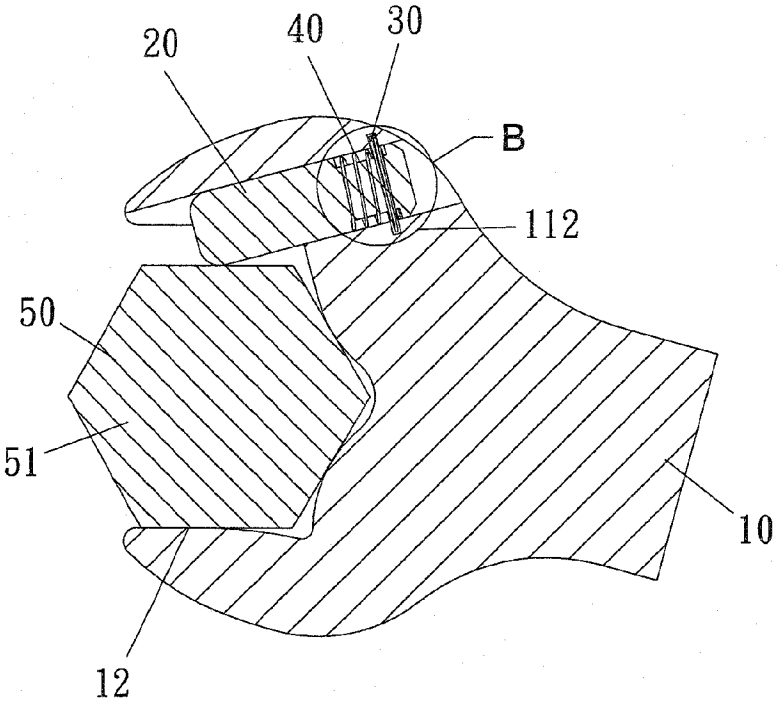
FIG. 13 is a cross sectional view of the second embodiment of the spring and the clip.
Figure 16:
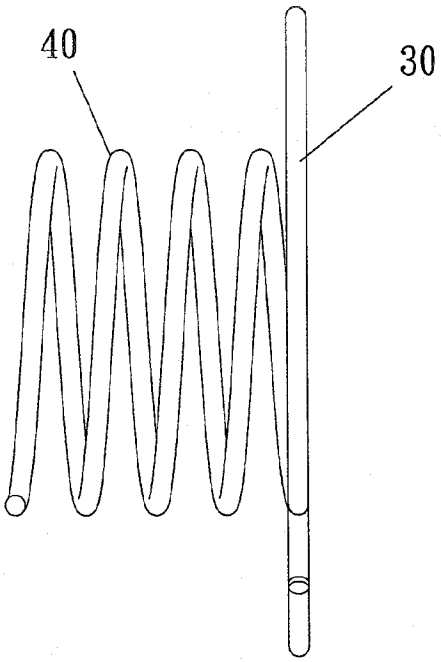
FIG. 16 is a side view of the third embodiment of the spring and the clip.
Figure 15:
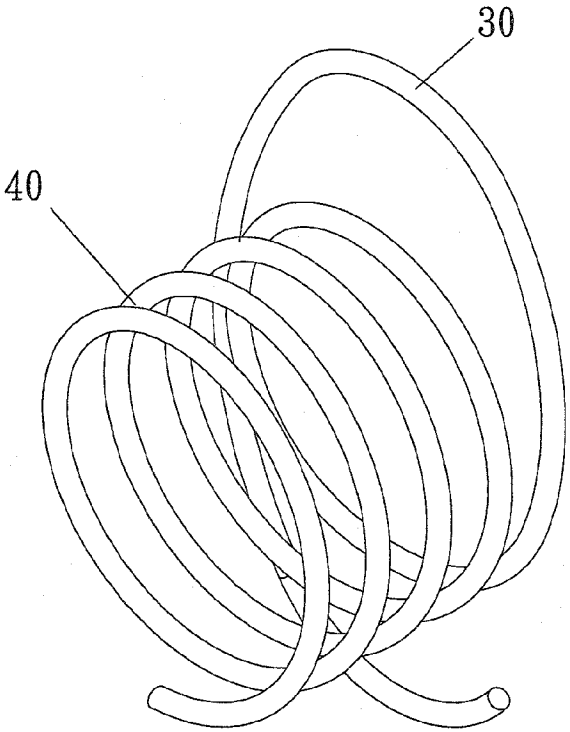
FIG. 15 shows the third embodiment of the spring and the clip.
Figure 17:
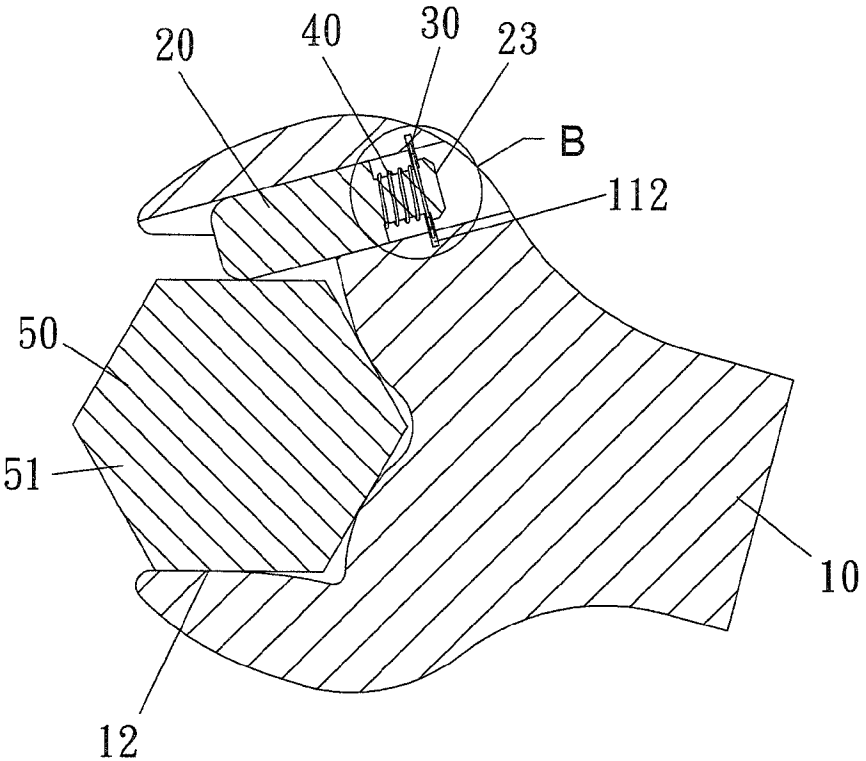
FIG. 17 is a cross sectional view of the third embodiment of the spring and the clip.
Figure 18:
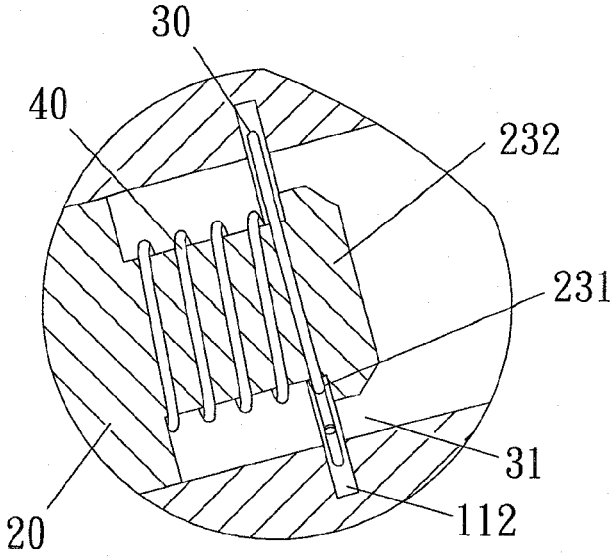
FIG. 18 is an enlarged view of the circle B in FIG. 17.
Figure 19:
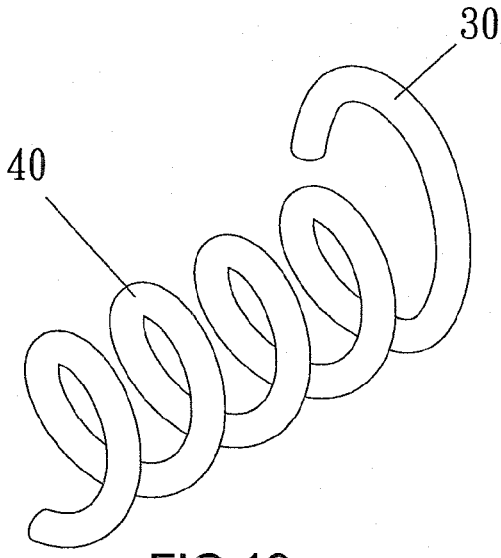
FIG. 19 shows the fourth embodiment of the spring and the clip.
Figure 20:
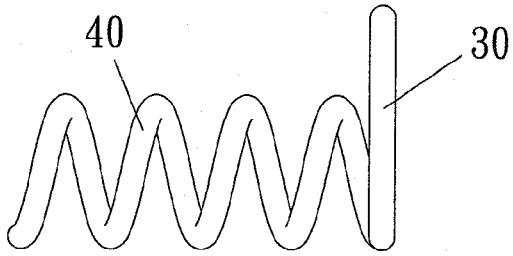
FIG. 20 is a side view of the fourth embodiment of the spring and the clip.
Figure 21:
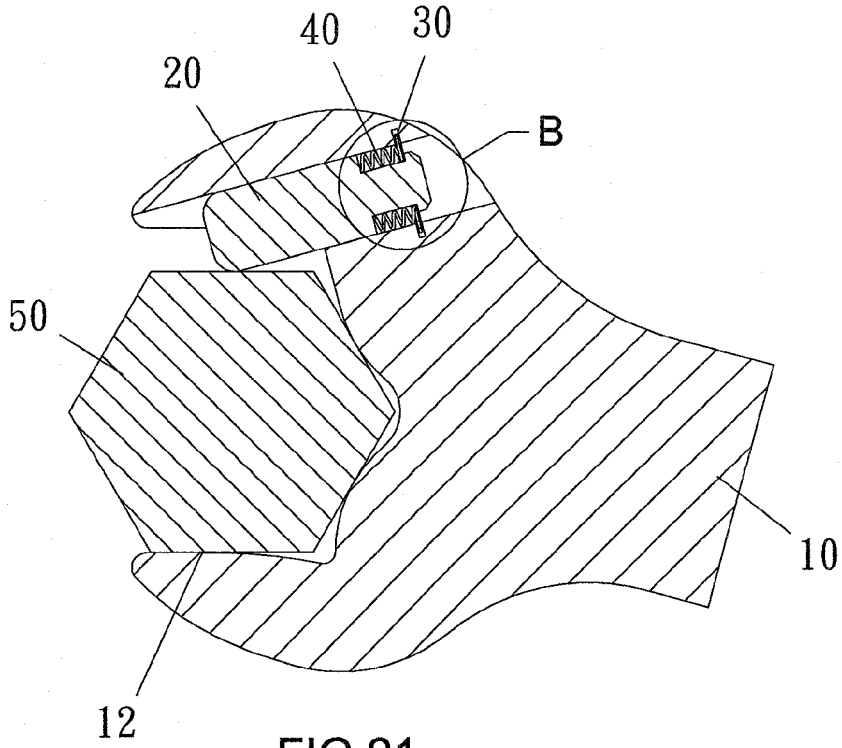
FIG. 21 is a cross sectional view of the fourth embodiment of the spring and the clip.

As shown in FIGS. 8 and 9, when the body 10 rotates the bolt 50 clockwise to an angle, the body 10 is then rotated counter clockwise, the distal end 21 is pushed by the bolt 50 and the spring 40 is compressed so that the movable member 20 is refracted in the passage 111. FIG. 10 shows that the body 10 is mounted to the bolt 50, the first clamp surface 12, the first engaging surface 14 and the second engaging surface 15 contact the three sides of the hexagonal head 51, the movable member 20 is pushed by the spring 40 and contacts the next side of the hexagonal head 51 so that the body 10 can rotate the bolt 50 clockwise again.

FIGS. 11 to 14 show that the spring 40 and the clip 30 are formed integrally as one piece. The outer diameter of the clip 30 is larger than the outer diameter of the spring 40. The clip 30 has one end contacting the spring 40 and the other end has a contact end 31 which has the same outer diameter of the spring 40. The spring 40 and the clip 30 are mounted to the extension 22 and the distal end of the spring 40 contacts the first shoulder 221. The movable member 20 is pushed into the passage 111. The clip 30 is engaged with the annular groove 112 and the contact end 31 contacts the second shoulder 231.

As shown in FIGS. 15 to 18, the spring 40 and the clip 30 are formed integrally as one piece. The width of each of top and bottom of the clip 30 is wider than the diameter of the spring 40. The width of a body portion between the top and bottom of the clip 30 has the same diameter of the spring 40. The spring 40 and the clip 30 are mounted to the extension 22 and body portion of the clip 30 contacts the second shoulder 231. The top and bottom of the clip 30 are engaged with the annular groove 112.

Referring to FIGS. 19 to 22, there are multiple sets of springs 40 and clips 30, each set of the spring 40 and the clip 30 are formed as one piece. The spring 40 and clip 30 are mounted to the extension 22. The outside of the clip 30 is engaged with the annular groove 112 and the inside of the clip 30 contacts the second shoulder 231.

Figure 23:
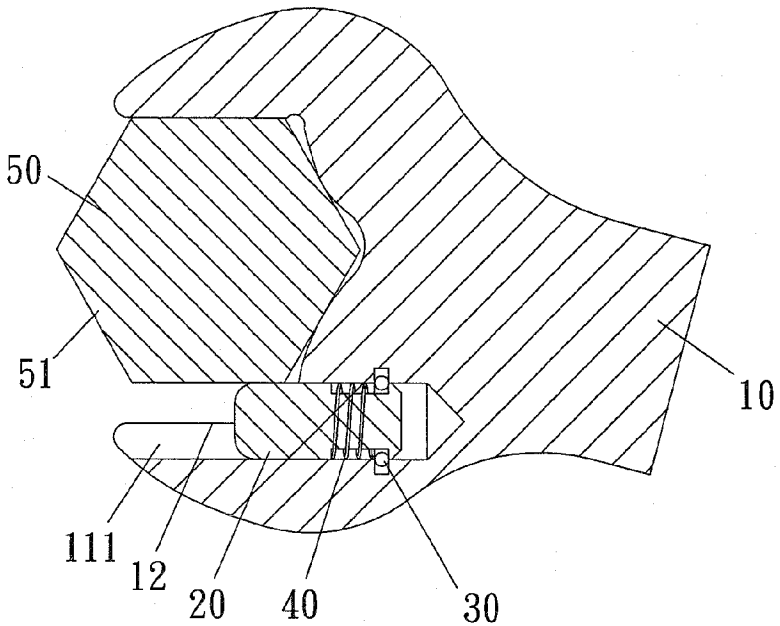
FIG. 23 shows yet another embodiment of the open wrench of the present invention.
Figure 22:
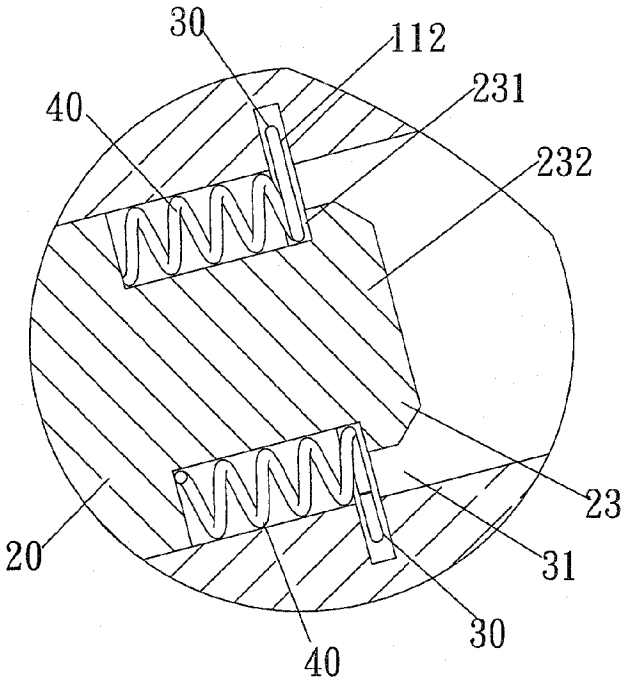
FIG. 22 is an enlarged view of the circle B in FIG. 21.

As shown in FIG. 23, the first and second clamp surfaces 12, 16 switch and the passage 111 is defined in the first clamp surface 12. The passage 111 does not extend through the driving head.

The movable member 20 has the extension 22 and the block 23 which is restricted by the clip 30, so that the movable member 20 is restricted in the passage 111. If the length of the extension 22 is not made correctly, because the extension 22 can be made to have an annular groove and the extension 22 can be easily machined to correct length. Even if the extension cannot be machined, the cost is low to discard the movable member 20.

The clip 30 is not expensive and can be made integrally with the spring 40, so that the number of parts can be reduced to reduce the manufacturing cost.

The distal end 21, the first clamp surface 12, the second engaging surface 14 and the third engaging surface 15 contact four sides of the hexagonal head 51 so that the bolt 50 can be firmly rotated.

While we have shown and described the embodiment in accordance with the present invention, it should be clear to those skilled in the art that further embodiments may be made without departing from the scope of the present invention.

What is claimed is:

1. An open wrench comprising:

a body having a handle and a driving head which is connected to an end of the handle, a recess is defined through the driving head so as to define a first clamp surface and a second clamp surface on two insides thereof, a first engaging surface extending from the second clamp surface and a second engaging surface extending from the first clamp surface, an opening defined between the first and second clamp surfaces and communicating with the recess, the first clamp surface, the first engaging surface and the second engaging surface respectively having a first tangential surface, a second tangential surface and a third tangential surface, the three respective tangential surfaces located on three consecutive sides of the recess for contacting three consecutive sides of a hexagonal head of a bolt, the second clamp surface having a most protruding portion which has a fourth surface which is parallel to the first tangential surface, the driving head having a passage defined therethrough;

a movable member movably received in the passage and having an extension extending from an end thereof, a diameter of the extension being smaller than a diameter of the movable member so as to define a first shoulder at a conjunction portion between the movable member and the extension, the extension having an enlarged block at a distal end thereof so as to define a second shoulder at the conjunction portion between the block and the movable member;

a spring mounted to the extension of the movable member and biased between the first shoulder and a clip engaged with an annular groove in the passage so as to provide a force to push the movable member toward the recess, and the movable member having a spherical distal end which protrudes from the second clamp surface, an angle defined between an axis of the passage and the fourth surface, a range of the angle being between 15 degrees to 25 degrees, an inner periphery of the clip protruding into the passage and engaged with the second shoulder to prevent the movable member from dropping from the passage.

2. The open wrench as claimed in claim 1, wherein a notch is defined in a connection portion between the first clamp surface and the first engaging surface.

3. The open wrench as claimed in claim 1, wherein the spring and the clip are formed integrally as one piece, an outer diameter of the clip is larger than an outer diameter of the spring, the clip has a contact end which has the same outer diameter of the spring, the spring and the clip are mounted to the extension and the contact end contacts the second shoulder.

4. The open wrench as claimed in claim 1, wherein the spring and the clip are formed integrally as one piece, a width of each of the top and bottom of the clip is wider than a diameter of the spring, a width of a body portion between the top and bottom of the clip has the same diameter of the spring, the spring and the clip are mounted to the extension and the body portion of the clip contacts the second shoulder, the top and bottom of the clip are engaged with the annular groove.

5. The open wrench as claimed in claim 1, wherein there are multiple sets of springs and clips, each set of the spring and the clip are formed as one piece, the spring and the clip are mounted to the extension, an outside of the clip is engaged with the annular groove and an inside of the clip contacts the second shoulder.

6. The open wrench as claimed in claim 1, wherein the first clamp surface is a curved and convex surface or a planar surface.

* * * * *